US006523689B2

(12) United States Patent
Mickel

(10) Patent No.: US 6,523,689 B2
(45) Date of Patent: Feb. 25, 2003

(54) RECLOSABLE CONTAINER WITH REMOVABLE BACKING CARD

(76) Inventor: Richard D. Mickel, 4078 Tarry La., Greenwood, IN (US) 46142

( * ) Notice: Subject to any disclaimer, the term of this patent is extended or adjusted under 35 U.S.C. 154(b) by 0 days.

(21) Appl. No.: 09/781,879

(22) Filed: Feb. 12, 2001

(65) Prior Publication Data

US 2002/0108878 A1 Aug. 15, 2002

(51) Int. Cl.[7] ..... B65D 73/00
(52) U.S. Cl. ..... 206/468; 206/471; 206/806
(58) Field of Search ..... 206/461, 464, 206/467, 468, 470, 471, 806; 220/345.1, 345.2

(56) References Cited

U.S. PATENT DOCUMENTS

| | | | | | |
|---|---|---|---|---|---|
| 2,975,889 | A | * | 3/1961 | Brown | 206/468 |
| 3,157,280 | A | * | 11/1964 | Perdue et al. | 206/468 |
| 4,739,883 | A | * | 4/1988 | Mohs et al. | 206/470 |
| 5,353,935 | A | | 10/1994 | Yeager et al. | |
| 5,593,036 | A | | 1/1997 | Dyble et al. | |
| 5,944,177 | A | * | 8/1999 | Nemoto | 206/232 |
| 6,016,914 | A | * | 1/2000 | Gustafson | 206/470 |
| 6,047,819 | A | | 4/2000 | Borst et al. | |
| 6,330,945 | B1 | * | 12/2001 | Reiner | 206/470 |

OTHER PUBLICATIONS

Web Page, Placon, Stock Packaging Advantage, Curved Box.

* cited by examiner

*Primary Examiner*—Shian Luong
(74) *Attorney, Agent, or Firm*—Michael C. Bartol; Lowe Gray Steele & Darko, LLP

(57) ABSTRACT

A reclosable blister container in which a backing card is slidably and removably retained in the blister without requiring staples or adhesives. The blister includes elongated grooves on opposite sides thereof that slidingly receive the backing card. The blister includes a step that is preferably curved, which facilitates slidable entry of the backing card into the blister. Protrusions may be formed in the blister that extend into corresponding openings in the backing card in order to further retain the backing card within the blister. The present invention provides a more attractive and more economical alternative to prior art "flange-folded" products.

24 Claims, 6 Drawing Sheets

RECLOSABLE CONTAINER WITH REMOVABLE BACKING CARD

FIELD OF THE INVENTION

The present invention relates generally to packaging and more specifically to thermoformed reclosable blister packs.

BACKGROUND

Clear plastic display packages are commonly used in retail sales environments where it is desired to present merchandise for visual inspection by the customer. Blister packages feature a transparent bubble, typically produced through a thermoforming process, which is sealed to a backing card. One conventional method of attaching the card is to place a heat-activated adhesive on it and heat the card to adhere the flanges of the thermoformed bubble thereto. Display packages with blisters adhered to paperboard backing cards are effective in showcasing the merchandise. Undesirably, however, adhesive backed cards are expensive and require an additional process step, viz., heating, to seal the package. Furthermore, once opened, these packages cannot be easily reclosed because the backing card is typically ripped apart and destroyed during opening.

Thermoformed plastic packages having integrally hinged covers with positive snap locking mechanisms are also known in the art and are commonly referred to as "clam-shells." These packages provide an attractive and functional container, but can require high initial tooling costs and high material costs not always justified by the product to be carried in the package. The tooling for these clam-shell designs also has size limitations in modern production equipment. Further, the clam-shell package requires a separate insert card to communicate the contents of the package.

Another popular and inexpensive blister-card design includes the blister having a flange around its periphery that folds unto itself, commonly referred by those skilled in the art as a "flange-fold." The flange-fold, which is essentially a 180 degree fold, forms a groove or channel into which the backing card is slidably inserted. The backing card is then typically stapled to the blister to hold it in place, thereby eliminating the need for adhesives. This design has at least two drawbacks. First, the staple lends a cheap or chintzy appearance to the package which, undesirably, may also be imported to the contents. Further, forming the flange-fold requires an additional, time-consuming process step after thermoforming and requires an additional costly piece of equipment to perform the flange fold.

What is needed is an economical reclosable display package which uses cost-effective materials and an economy thereof, and whose manufacture can be performed cost-effectively.

SUMMARY OF THE INVENTION

The present invention is a reclosable blister container in which a backing card is slidably and removably retained in the blister without requiring staples or adhesives. The blister includes elongated grooves on opposite sides thereof that slidingly receive the backing card. The blister includes a step that is preferably curved, which facilitates slidable entry of the backing card into the blister.

In one form thereof, the present invention provides a reclosable container comprising a thermoplastic blister having a bubble defining a container cavity. A flange extends laterally from the bubble. A side wall extends upwardly from the flange. The side wall defines an elongated groove extending along at least one third of its length. A skirt extends laterally from the sidewall, the skirt defining a plane spaced from the flange. A backing card is slidably and removably received in the groove and abuts the flange.

In a preferred form, the flange comprises a step connecting it to the skirt, and the step is angled relative to the flange. With this arrangement, the step facilitates slidable receipt of the backing card into the blister. More preferably, the step is curved.

In a further preferred form, either the skirt or the flange, or both, include a protrusion that mates with the backing card and retains the backing card in the blister. In a further preferred form, the protrusion fits into a complementary opening in the backing card. In another preferred form, the protrusion extends from the skirt and projects over the step such that an edge of the backing card fits under the protrusion and is held against the step.

The reclosable container is preferably and conveniently integrally formed as one piece.

In another form thereof, the present invention provides a reclosable container comprising a thermoplastic blister having a bubble defining a container cavity. A flange extends laterally from the bubble and a side wall extends upwardly from the flange. The side wall defines a groove at a lower end thereof, and a backing card is slidably and removably retained in the groove and abuts the flange. The flange is curved upwardly at an end thereof, which facilitates slidable receipt of the backing card into the blister.

In a preferred form thereof, the groove extends continuously along at least one third of the length of the side wall. More preferably, the blister is integrally formed in one piece.

One advantage of the present invention is that it eliminates the costly adhesive-backed cards employed in prior art containers and it also avoids the concomitant process steps of heating the card and adhering it to the blister. Instead, with containers embodying the present invention, the card is simply fed into the blister and is retained by the blister alone. With the present invention, no staples, glue, adhesives, tape or any other tools are necessary to secure the backing card to the blister.

Another advantage of the present invention is that containers embodying it can be opened and closed as many times as desired without destroying the container. To open the container, the backing card is simply pried away from the blister and slid therefrom. The container can be easily re-closed by reinserting the card and sliding it back into the blister.

Yet another advantage of the present invention is that it avoids the time-consuming and costly process step of "flange-folding" the blister. The present invention also obviates the costly piece of equipment whose sole purpose is to flange-fold the blisters. Further, the present invention eliminates the unsightly staple and process step to install it which is typically associated with flange-folded blisters. Indeed, the present invention fulfills a long-felt need for an inexpensive replacement to the flange-folded blister design.

Still another advantage of the present invention is that it provides a reasonable alternative for clam-shell containers. As mentioned above, clam-shell type containers provide an attractive and functional reclosable container, but their high cost is not always justified by the cost of the product being packaged therein. Flange-folded containers, on the other hand, are often not perceived in the industry as a suitable replacement for clam-shells because the poor quality perceived by the consumer of the flange-folded container can be transferred to the product, thereby negatively affecting sales. Of course, with any product, the packaging effects the perceived quality of the product. Because containers in accordance with the present invention provide a high quality appearance, they offer a plausible alternative to costly clamshells for many packaging applications.

Amazingly, containers made in accordance with the present invention not only provide a more attractive package than one which is flange-folded, but they also provide a significant cost savings over a flange-folded product. Specifically, it is estimated that a container made in accordance with the present invention would cost approximately 25% less than its flange-folded counterpart.

BRIEF DESCRIPTION OF DRAWINGS

The above-mentioned and other advantages of the present invention, and the manner of obtaining them, will become more apparent and the invention itself will be better understood by reference to the following description of the embodiments of the invention taken in conjunction with the accompanying drawings, wherein.

Corresponding reference characters indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
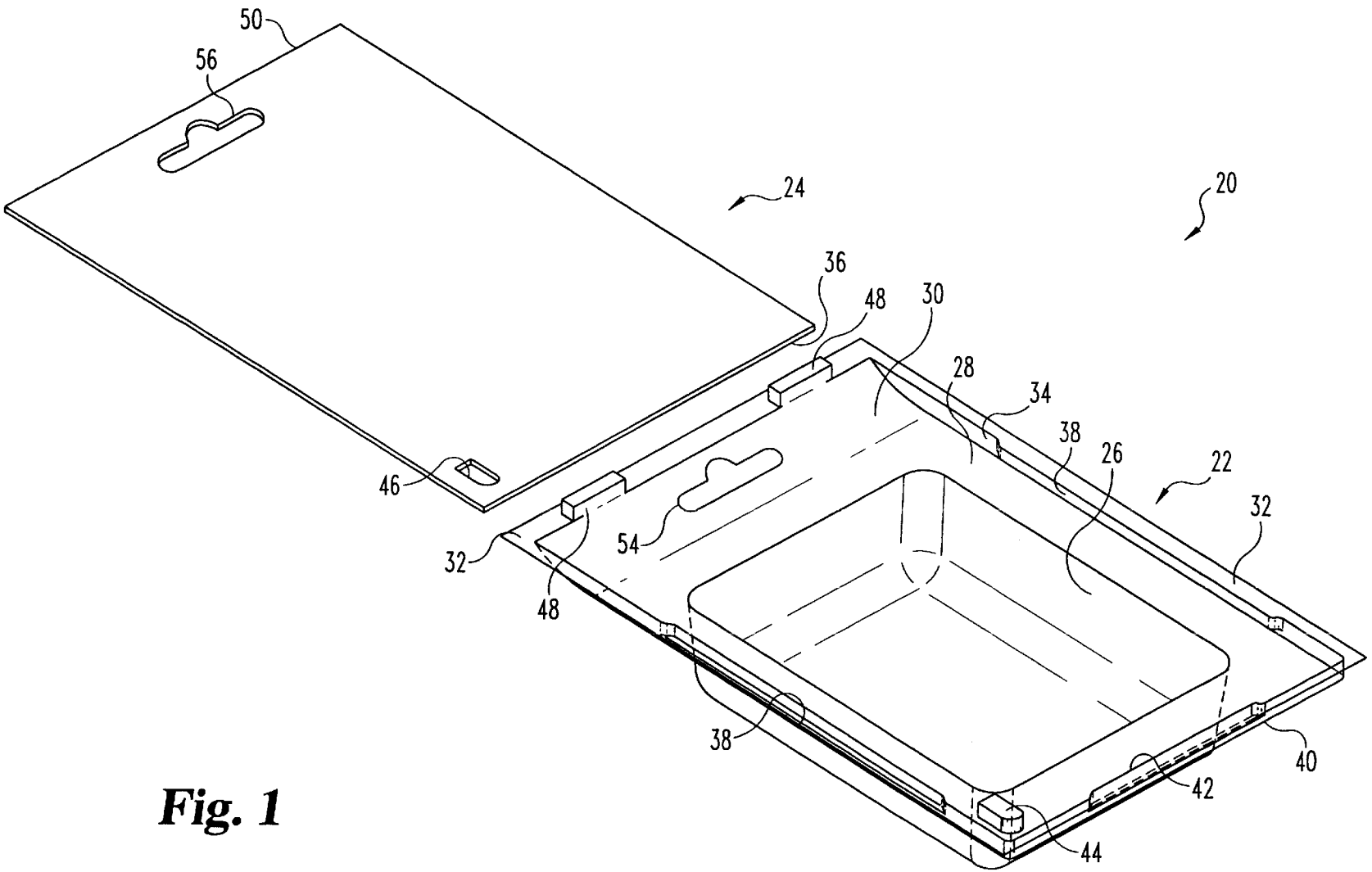
FIG. 1 is a perspective view of a reclosable container in accordance with the principles of the present invention, illustrating the backing card separated from the blister.

Referring now to FIG. 1, container 20 includes thermoformed blister 22 and a paper board backing card 24. One suitable backing card 24 would be a 21 point blister card with an optional heat activated adhesive. Backing card 24 may be formed of any stiff single or multi-ply paper or other suitable material and may be printed on one or both sides. Blister 22 is integrally formed in a single piece from 0.020 inch stock polyvinyl chloride (PVC) stock sheets, commercially available from Klockner Co. and American Mirrex Co. Blister 22 can be formed by a conventional thermoforming processes, wherein a thermoplastic sheet is heated and pulled down onto a mold surface to be shaped into blister 22 as shown As shown in FIG. 1, blister 22 includes bubble 26 which defines a container cavity into which the product to be displayed and sold is placed. A flange 28 extends laterally away from the bottom (or top, depending on how the package is viewed) of bubble 26. Flange 28 is substantially planar, with the exception of one of its ends which curves upwardly, as described in more detail below. Along three sides of flange 28, sidewall 34 extends upwardly, generally orthogonally from the major plane defined by flange 28. Along the periphery of the top of sidewall 34, skirt 32 extends laterally outwardly and generally defines the outer confines of container 20. Skirt 32 defines a plane that is spaced from the plane defined by flange 28 and is substantially parallel thereto.

As just alluded to, on one of the four sides of blister 22, curved portion 30 integrally connects flange 28 to skirt 32. Curved portion 30 facilitates slidable receipt of backing card 24 into blister 22 and also facilitates nesting of multiple blisters 22. Further, curved portion 30 facilitates thermoforming blister 22, in that the curved portion eliminates the gap between the plastic and the mold when hang tab 54 is being punched, which thereby eliminates undesirable whitening or bulging of the blister. Curved portion 30 also allows the blisters to be more easily pulled from the mold.

To close container 20, edge 36 of backing card 24 is placed against curved portion 30 and slid therealong until edge 36 fits into grooves 38 that are disposed on opposite of the longer sides of blister 22. Grooves 38 slidingly receive backing card 24 and retain same in an abutting relationship against flange 28 of blister 22. As also shown in FIG. 1, edge 36 is received in optional groove 42 disposed at end 40 of blister 22 and retained against flange 28 when backing card 24 is fully inserted into blister 22. Groove 42 is formed in the same shape and configuration as grooves 38. To further aid retention of backing card 24 in blister 22, protrusion 44 is received into complementary opening 46 formed in backing card 24 Protrusions 48 formed in skirt 32 abut against edge 50 of backing card 24 when fully inserted into blister 22 to also help retain backing card 24 in blister 22. Backing card 24 is removably retained by blister 22. To remove the backing card, one or more fingers or fingernails are used to pull upward on edge 50 of card 24. Once edge 50 is pulled sufficiently away from the blister, it can be easily slid from the blister to allow access to the contents.

Matching hang tabs 54 and 56 in blister 22 and card 24, respectively, allow the closed container 20 to be hung from a display hanger (not shown), which usually takes the form of a thin metal rod extending from the display and having its end bent upwardly, as is widely known in the art. Typically, many containers of an identical item are hung from the same rod such that the consumer takes as many containers as needed, the remainder being left for future customers.

Figure 2:
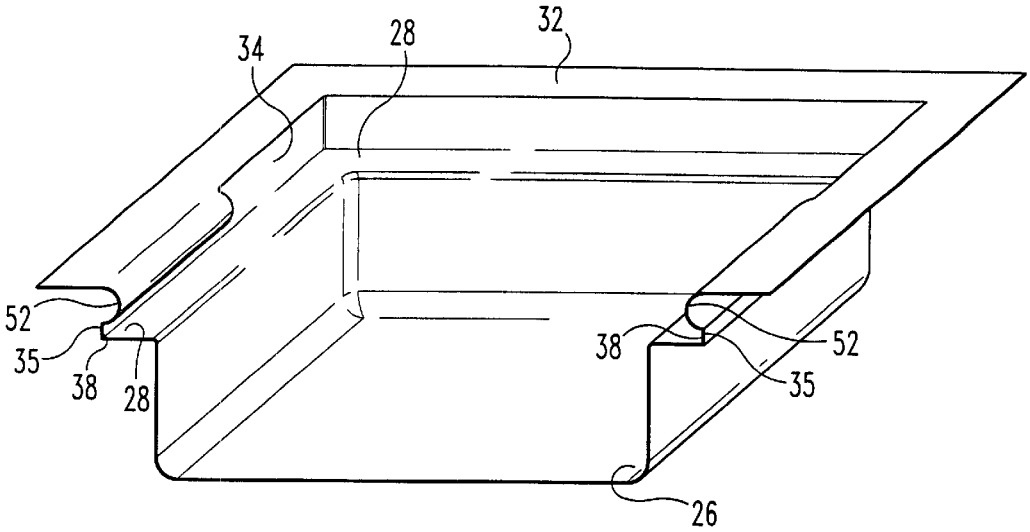
FIG. 2 is a sectional perspective of the container illustrated in FIG. 1.

Turning now to FIG. 2, the further details of grooves 38 can be appreciated. As shown, sidewall 34 forms a bulge 52 along a portion thereof. Vertical portion 35 of sidewall 34 serves to space bulge 52 away from flange 28 sufficiently such that backing card 24 is slidably retained therebetween. Bulge 52 extends inwardly toward bubble 26 and projects over flange 28 as shown in FIG. 2. Preferably, bulge 52 has a semicircular shape shown in FIG. 2 and shown more closely in FIG. 3*a*. However, bulge 52 can take any of a variety of shapes such as shown in FIGS. 3*b*–3*j*.

Figure 3A:
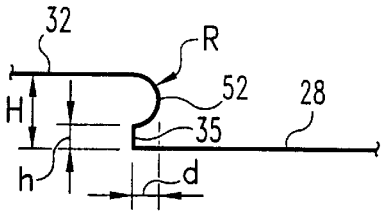
FIGS. 3*a*–3*j* are fragmentary sectional views of various embodiments of the side wall, flange and groove of blisters in accordance with the present invention.
Figure 3B:
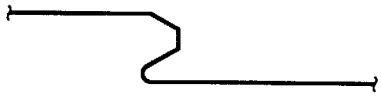
Figure 3C:
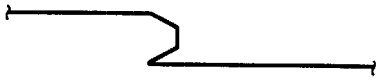
Figure 3D:
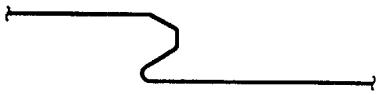
Figure 3E:
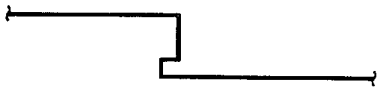

Referring now to FIGS. 2 and 3*a*, it can be appreciated that bulge 52 and the portion of flange 28 which bulge 52 projects over form groove 38 therebetween. Groove 38 is preferably formed continuously along side wall 34 for at least one-third of the total length of side wall 34, more preferably at least one-half of the total length of side wall 34.

It has been found that the integrity of the fit and retention of card 24 in blister 22 is improved with increased continuous length of groove 38, as one of ordinary skill in the art might expect. However, forming a long groove 38 presents problems in the molding process because the blister has an increased propensity to stick to the mold as the length of groove 38 increases. To combat this problem, it has been found that the geometric configuration of bulge 52 and sidewall portion 35 inherently facilitates removal of the blister after molding. Indeed, one of the achievements of the present invention is the ability to form a long, continuous groove like groove 38 without the blister sticking to the mold and the part becoming damaged upon removal of the blister from the mold. While less preferable than a long, continuous groove, it is also possible to form a series of discrete bulges spaced along a portion of side wall 34 (not shown). Such a thermoformed product would be easier to mold.

It is to be understood that the specific dimensions of groove 38 could vary widely depending upon thickness, stiffness and other characteristics of backing card 24, the type and thickness of the thermoformed plastic used for blister 22, and the overall size of the container. Nonetheless, it has been found that for a 0.020 inch plastic blister 22 and a 21 point backing card 24, specific dimensions for groove 38 having a semicircular bulge 52 have been proved satisfactory. For the preferred embodiment known at the time of this writing, as shown in FIG. 3*a*, the Height, H of side wall 34 is preferably about 0.1875 inches. Height, h, of groove 38, radius, R, of bulge 52 and depth, d, of groove 38 are all about 0.0625 inches in this preferred embodiment. Again, it cannot be overstated that these dimensions recited herein are merely descriptive of the preferred embodiment known at the time of this writing, and are in no way to be construed as limiting the invention defined by the appended claims.

Figure 3F:
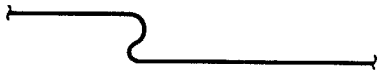
Figure 3G:
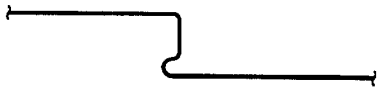
Figure 3H:
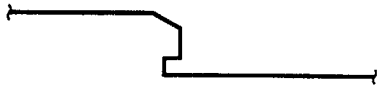
Figure 3I:
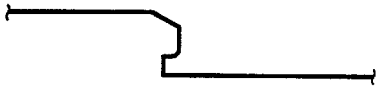
Figure 3J:
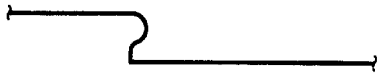

Indeed, it is contemplated that many of the designs for side wall 34 depicted in FIGS. 3*b* through 3*j* would perform suitably. Two primary considerations factor into the design choice for side wall 34—first, the extent and quality with which the backing card is releasably retained in the blister, and second, the ease with which the bulge/groove can be formed in the thermoforming process and the molded part easily removed. As shown in FIGS. 3*b*–3*j*, the shape of the bulge/groove formed in side wall 34 can be polygonal (FIGS. 3*b*, 3*c* and 3*h*), square or rectangular (FIGS. 3*e* and 3*g*) or mostly round (FIGS. 3*a*, 3*f* and 3*j*). Further, the groove, itself, can be rounded (FIGS. 3*b*, 3*d*, 3*f*, and 3*g*), pointed.(FIG. 3*c*) or rectangular (FIGS. 3*a*, 3*e*, 3*h*, and 3*i*). Certain designs of the bulge and groove may result in the blister undesirably sticking to the mold. In such cases, one solution envisioned is a spring-loaded, pivotable mold which allows the part of the mold that forms the bulge 52 to pivot upwardly when removing the blister. Other modifications to the mold may also be made by one of ordinary skill. Or, as in the case of the presently preferred design shown in FIG. 3*a*, the inherent configuration of semicircular bulge 52 and sidewall portion 35 inherently facilitates removal of the blister from the mold. It can now be readily appreciated by one of ordinary skill in the art, that while dimensions for a currently preferred embodiment have been recited herein, many other shapes, sizes and configurations of side wall 34, which defines groove 38, are possible.

Figure 4A:
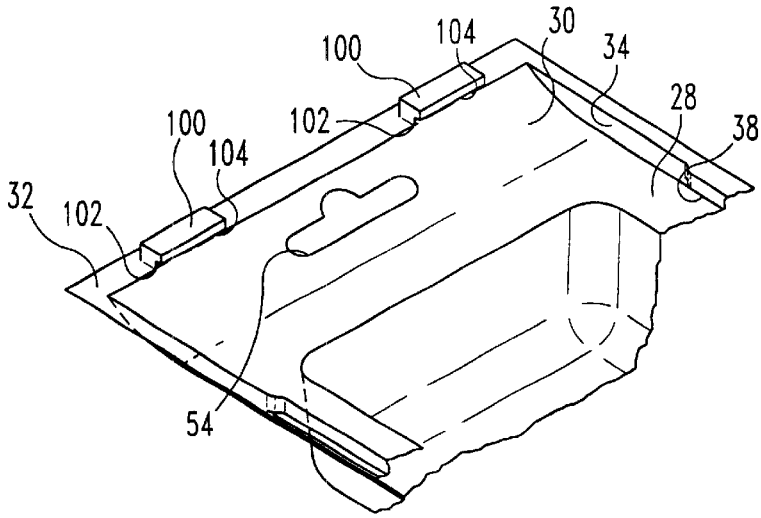
FIGS. 4*a*–4*e* are fragmentary perspective views of alternate embodiments of blister containers in accordance with the present invention, illustrating various configurations of protrusions which engage and retain the backing card.
Figure 4B:
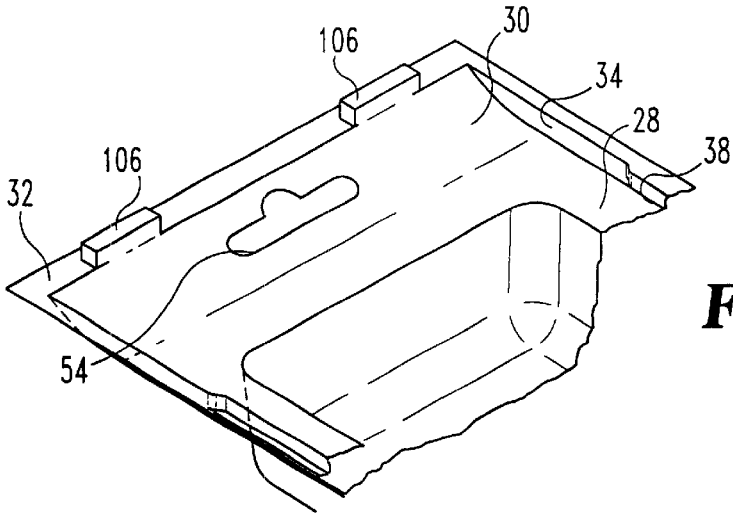
Figure 4C:
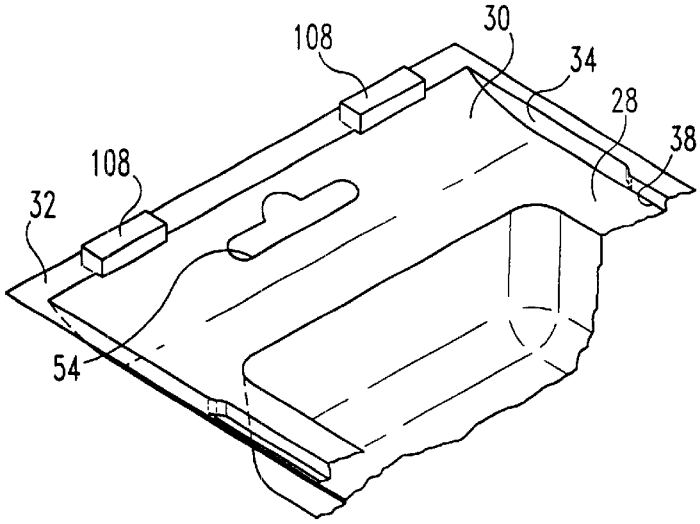
Figure 4D:
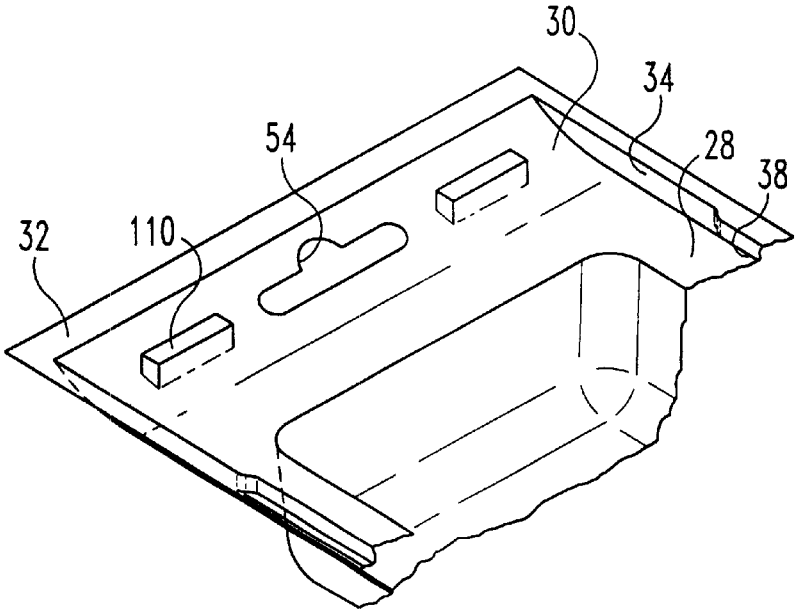
Figure 4E:
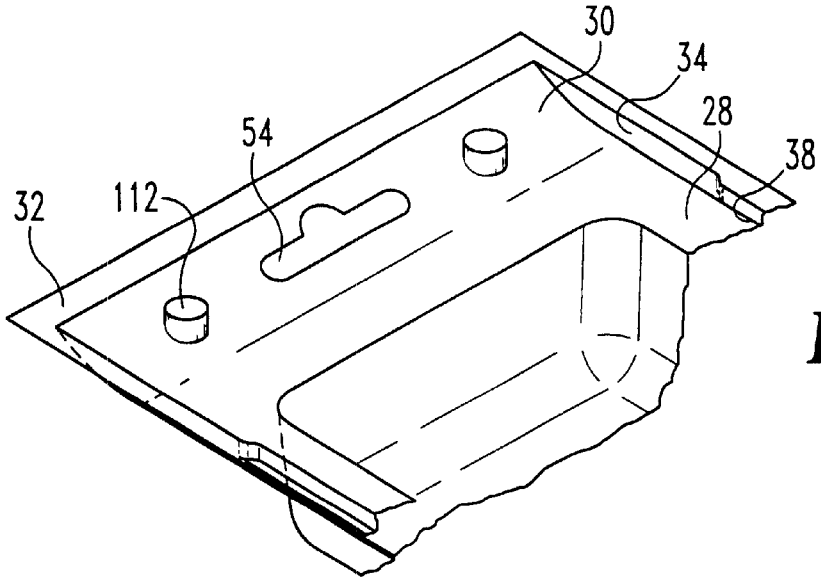

Turning now to FIGS. 4*a*–4*e*, alternate embodiments of the projections or protrusions that aid retention of the backing card are illustrated. As shown in FIG. 4*a*, substantially rectangular protrusions 100 extend upwardly from skirt 32 and are formed with rectangular cut-out sections 102 which further define ledges 104 that project over curved portion 30 and sandwich the backing card (not shown in FIG. 4*a*) therebetween. Protrusions 100 represent the preferred embodiment. However, other configurations of the protrusions are possible. FIG. 4*b* illustrates substantially rectangular protrusions 106 that extend upwardly from skirt 32. Protrusions 106 have a width that substantially coincides with the width of skirt 32. As shown in FIG. 4*c*, substantially rectangular protrusions 108 extend upwardly from skirt 32 and "hang over" curved portion 30 such that the backing card (not shown in FIG. 4*c*) is pinched between curved portion 30 and protrusions 108. FIGS. 4*d* and 4*e* illustrate that the protrusions can be formed on curved portion 30 instead of skirt 32. Substantially rectangular protrusions 110 extend from curved portion 30 shown in FIG. 4*d* whereas substantially cylindrical protrusions 112 extend from curved portion 30 shown in FIG. 4*e*. In the alternate embodiments shown in FIGS. 4*d* and 4*e*, the backing card would be formed with complementary openings to receive the respective protrusions.

Figure 5A:
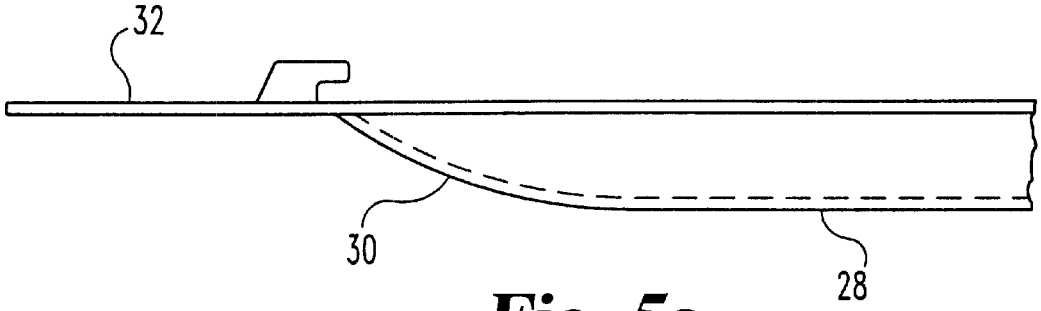
FIGS. 5*a*–5*c* are schematic side views illustrating alternate embodiments of a step which facilitates installation of the backing card into the blister.
Figure 5B:
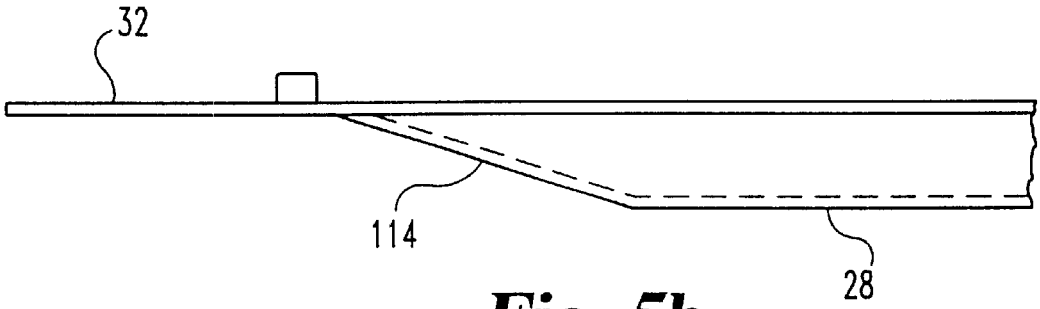
Figure 5C:
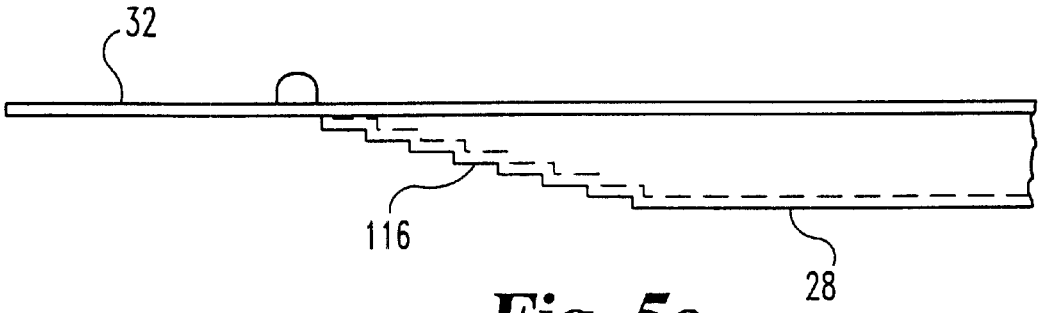

While portion 30 which connects skirt 32 to flange 28 has been described hereinabove as being curved, other configurations are possible. More generally, embodiments incorporating the present invention will include a "step" connecting skirt 32 to flange 28 and which facilitates slidable engagement of the backing card into the blister. Advantageously, the step is angled relative to the flange as shown, which encourages the edge of the backing card to easily slide into the blister. Turning to FIG. 5*a*, the step is formed as the preferred curved portion 30. In FIG. 5*b*, the step is shown as substantially flat ramp 114 and in FIG. 5*c*, the step is formed as staircase 116. These and many other embodiments are envisaged as possible for the step which connects skirt 32 to flange 28 and facilitates insertion of card 24.

Figure 6:
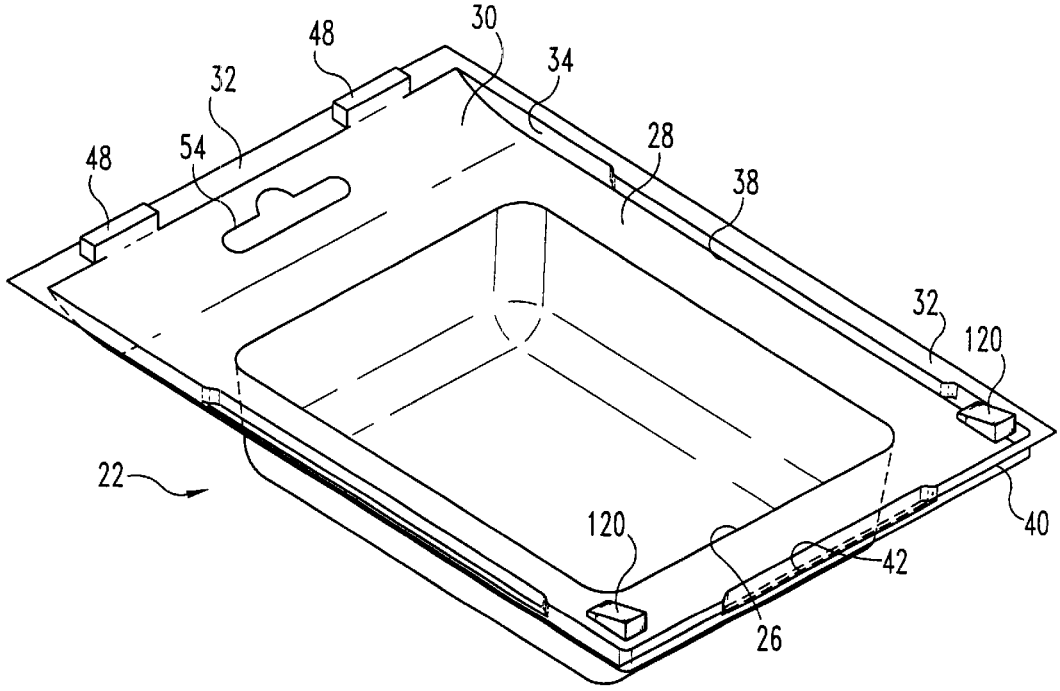
FIG. 6 is a perspective view of a container in accordance with an alternate embodiment of the present invention.

The blister depicted in FIG. 6 is similar to that depicted in FIG. 1, except FIG. 6 depicts an alternate embodiment of the protrusion 48 illustrated in FIG. 1. With reference to FIG. 6, flange 28 includes two ramp-shaped protrusions 120 which fit through complementary shaped openings in backing card 24 (not shown in FIG. 6) and help retain backing card 24 in blister 22. The ramp shape of protrusions 120 allows the backing card to slide into the blister without getting stuck against the protrusions, such that the end of the backing card need not be lifted upwardly in order to fully insert the card into the blister.

It can now be appreciated that the present invention provides a cost-effective reclosable container that addresses the high costs and disadvantages associated with prior art reclosable blister containers.

While a preferred embodiment incorporating the principles of the present invention has been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reclosable container, comprising:

a thermoplastic blister having a bubble defining a container cavity;

a flange extending laterally from said bubble;

a side wall extending upwardly from said flange, said side wall defining an elongated groove extending at least one third the length of said sidewall;

a skirt extending laterally from said sidewall, said skirt spaced from said flange; and a backing card removably retained in said groove and abutting said flange, said backing card sliding in the longitudinal direction of said groove when inserted and removed from said blister, whereby said backing card can be completely removed from and slidably reinserted into said blister multiple times without destroying said backing card.

2. The reclosable container of claim 1, wherein said flange comprises a step connecting said skirt thereto, said step being angled relative to said flange, whereby said step facilitates slidable receipt of said backing card into said blister.

3. The reclosable container of claim 2, wherein said step is curved.

4. The reclosable container of claim 2, wherein one of said skirt and said flange comprises a protrusion that mates with said backing card and retains said backing card in said blister.

5. The reclosable container of claim 4, wherein said protrusion fits into a complementary opening in said backing card.

6. The reclosable container of claim 4, wherein said protrusion extends from said skirt and projects over said step, an edge of said backing card fitting under said protrusion and held against said step.

7. The reclosable container of claim 1, wherein said blister is integrally formed.

8. The reclosable container of claim 1, wherein said groove comprises a continuous groove.

9. The reclosable container of claim 1, wherein said groove extends continuously along at least one third of the length of said side wall.

10. The reclosable container of claim 1, wherein said flange is curved upwardly at an end thereof.

11. The reclosable container of claim 1, wherein said groove comprises a bulge which further comprises a semicircular shape.

12. The reclosable container of claim 11, wherein said bulge is continuous.

13. A reclosable container, comprising:

a thermoplastic blister having a bubble defining a container cavity;

a flange extending laterally from said bubble;

a side wall extending upwardly from said flange, said side wall defining an elongated groove extending at least one third the length of said sidewall;

a skirt extending laterally from said sidewall, said skirt defining a plane spaced from said flange;

a backing card slidably and removably received in said groove and abutting said flange;

one of said skirt and said flange comprising a protrusion that mates with said backing card and retains said backing card in said blister; and said flange comprising a step connecting said skirt thereto, said step being angled relative to said flange, whereby said step facilitates slidable receipt of said backing card into said blister.

14. The reclosable container of claim 13, wherein said protrusion fits into a complementary opening in said backing card.

15. The reclosable container of claim 13, wherein said protrusion extends from said skirt and projects over said step, an edge of said backing card fitting under said protrusion and held against said step.

16. The reclosable container of claim 13, wherein said step is curved.

17. The reclosable container of claim 13, wherein said groove comprises a continuous groove.

18. A reclosable container, comprising:

a thermoplastic blister having a bubble defining a container cavity;

a flange extending laterally from said bubble;

a side wall extending upwardly from said flange, said side wall defining a groove at a lower end thereof;

a backing card slidably and removably retained in said groove and abutting said flange;

said flange curved upwardly at an end thereof, whereby slidable receipt of said backing card into said blister is facilitated;

a skirt extending laterally from said sidewall, said skirt defining a plane spaced from said flange, the curved portion of said flange connected to said skirt; and one of said skirt and said flange comprising a protrusion that mates with said backing card and retains said backing card in said blister.

19. The reclosable container of claim 18, wherein said protrusion fits into a complementary opening in said backing card.

20. A reclosable container, comprising:

a thermoplastic blister having a bubble defining a container cavity;

said blister forming a flange extending laterally from said bubble;

said blister further defining a side wall extending upwardly from said flange, said side wall forming a bulge extending along a portion thereof and projecting over said flange, said bulge spaced away from said flange and defining a groove therebetween;

a skirt extending laterally from said sidewall, said skirt defining a plane spaced from said flange;

said flange including a step portion on a side thereof, said step portion connecting said skirt to said flange and angled relative to said flange;

a backing card slidably and removably received in said groove and abutting said flange; and a protrusion extending from one of said flange and said skirt, said protrusion extending through a complementary opening in said backing card.

21. The reclosable container of claim 20, wherein said bulge comprises a semicircular shape.

22. The reclosable container of claim 20, wherein said step is curved.

23. The reclosable container of claim 20, wherein said bulge extends along at least one third of said side wall.

24. The reclosable container of claim 20, wherein said bulge is continuous.

* * * * *